US010368593B2

(12) United States Patent
Romo

(10) Patent No.: US 10,368,593 B2
(45) Date of Patent: Aug. 6, 2019

(54) HIGH-VISIBILITY VEST AND METHOD

(71) Applicant: Albert Romo, Dallas, TX (US)

(72) Inventor: Albert Romo, Dallas, TX (US)

( * ) Notice: Subject to any disclaimer, the term of this patent is extended or adjusted under 35 U.S.C. 154(b) by 186 days.

(21) Appl. No.: 15/657,037

(22) Filed: Jul. 21, 2017

(65) Prior Publication Data

US 2018/0020747 A1 Jan. 25, 2018

Related U.S. Application Data

(60) Provisional application No. 62/365,971, filed on Jul. 22, 2016.

(51) Int. Cl.

| | |
|---|---|
| ***A41D 13/01*** | (2006.01) |
| ***A41D 1/04*** | (2006.01) |
| ***A41D 27/20*** | (2006.01) |
| ***A41D 31/00*** | (2019.01) |
| ***A41D 27/18*** | (2006.01) |

(52) U.S. Cl.

CPC ..... *A41D 13/01* (2013.01); *A41D 1/04* (2013.01); *A41D 27/18* (2013.01); *A41D 27/20* (2013.01); *A41D 31/00* (2013.01); *A41D 2300/32* (2013.01); *A41D 2300/322* (2013.01); *A41D 2600/20* (2013.01)

(58) Field of Classification Search

CPC ..... A41D 13/01; A41D 1/04

See application file for complete search history.

(56) References Cited

U.S. PATENT DOCUMENTS

| | | | | |
|---|---|---|---|---|
| 3,501,616 | A * | 3/1970 | Aaron | H05B 3/342 2/93 |
| 3,849,804 | A | 11/1974 | Rakow | |
| 4,569,089 | A | 2/1986 | Nesse | |
| 5,054,125 | A | 10/1991 | Snedeker | |
| 5,588,154 | A | 12/1996 | Blauer et al. | |
| 2006/0034064 | A1* | 2/2006 | Kanzler | A41D 13/01 362/84 |
| 2008/0089056 | A1 | 10/2008 | Grosjean | |
| 2014/0059749 | A1 | 3/2014 | Fofana et al. | |
| 2014/0338091 | A1* | 11/2014 | Kenney | A41D 27/24 2/69 |
| 2015/0309219 | A1* | 10/2015 | Butz | G02B 5/0891 359/361 |
| 2017/0181482 | A1* | 6/2017 | Bruce | A41D 1/04 |

* cited by examiner

*Primary Examiner* — Tajash D Patel

(74) *Attorney, Agent, or Firm* — Integrity Patent Group, PLC; Charles E. Runyan

(57) ABSTRACT

A high-visibility includes a sleeveless garment having a collar, a plurality of reflective torso stripes, and a reflective collar stripe. The high-visibility vest is to be worn on a torso of a wearer-user and is useful for providing higher visibility to a torso area and a neck area of the wearer-user with a polished and professional appearance.

20 Claims, 5 Drawing Sheets

HIGH-VISIBILITY VEST AND METHOD

CROSS-REFERENCE TO RELATED APPLICATION(S)

The present application is related to and claims priority to U.S. Provisional Patent Application No. 62/365,971 filed Jul. 22, 2016, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of apparel of existing art and more specifically relates to safety vests.

RELATED ART

Apparel may include fiber and textile material worn on the body. The amount and type of apparel worn depends on social and safety considerations when on a job site. Safety vests have been used with construction workers, police officers, school attendants, and in a variety of other jobs that require high-visibility apparel. However, while the safety vests may meet safety considerations, the social factors are lacking. Presently, safety vests lack a desired image that people may desire to project, such as a professional appearance. Therefore, a suitable solution is desired.

U.S. Pat. No. 3,849,804 to Rakow relates to light reflective safety wearing apparel. The described light reflective safety wearing apparel includes light reflective material that is applied directly to a localized area on the inner side of a trouser leg, coat sleeve or skirt so that the garment may be turned up to form a temporary cuff thereby to expose the light reflective material to view in the dark for warning the driver of a moving vehicle of the presence of the wearer in or near the path of the vehicle. In the normal use of the garment, i.e., with the cuff turned down, the light reflective material is concealed from view. According to another form of the invention, light reflective material is applied directly to a localized area of a jacket or coat and is normally concealed from view by the turned down collar of the coat. The coat collar may be turned up thereby to expose the light reflective material to view for the purpose noted hereinabove. In each of the several forms of the invention, except for the presence of the light reflective material applied directly to the garment in the manner noted hereinabove, the garment as a whole is conventional and each part thereof is a customary part of such a garment constructed in a conventional manner.

SUMMARY OF THE INVENTION

In view of the foregoing disadvantages inherent in the known safety vest art, the present disclosure provides a novel high-visibility vest and method. The general purpose of the present disclosure, which will be described subsequently in greater detail, is to provide a high-visibility vest and method.

A high-visibility vest for a wearer-user is disclosed herein. The high-visibility vest includes a sleeveless garment configured to be worn on a torso of the wearer-user, the sleeveless garment having an inside and an outside, and including two arm-apertures and a neck-aperture, the neck aperture having an interior circumference, a collar coupled to the sleeveless garment and extending outward from the neck-aperture, the collar including an outward fold, a plurality of reflective torso stripes affixed to the sleeveless garment in a torso area of the outside of the sleeveless garment, the plurality of reflective torso stripes configured to provide high-visibility of the torso of the wearer-user, and a reflective collar stripe affixed to the collar, and configured to provide high-visibility of a neck area of the wearer-user.

According to another embodiment, a method of using a high-visibility vest is also disclosed herein. The method of using the high-visibility vest includes providing a high-visibility vest including a sleeveless garment and a plurality of reflective torso stripes affixed to the sleeveless garment in a torso area of an outside surface of the sleeveless garment, coupling a collar to the sleeveless garment, said collar including a reflective collar stripe affixed to the collar, and said collar coupled in an upper area of the sleeveless garment such that it is configured to provide high-visibility of a neck area of a wearer-user, and wearing the high-visibility vest with the collar coupled thereto.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a high-visibility vest and method, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a safety vest and more particularly to a high-visibility vest and method as used to improve a sleeveless garment appearance and safety for a wearer-user.

Generally, without proper safety attire, personnel such as officers or construction workers may be injured on the job. Workers may not be able to be identified in dimly lit conditions on such job sites. Moreover, with present safety vests, the head and neck area on a wearer-user are left with lower visibility. With the present disclosure, the safety vest may provide higher visibility to the head and neck region of the body, while providing a more polished and professional appearance, such as for a supervisor.

Referring now more specifically to the drawings by numerals of reference, there is shown in FIGS. 1-4, various views of a high-visibility vest 100.

Figure 1:
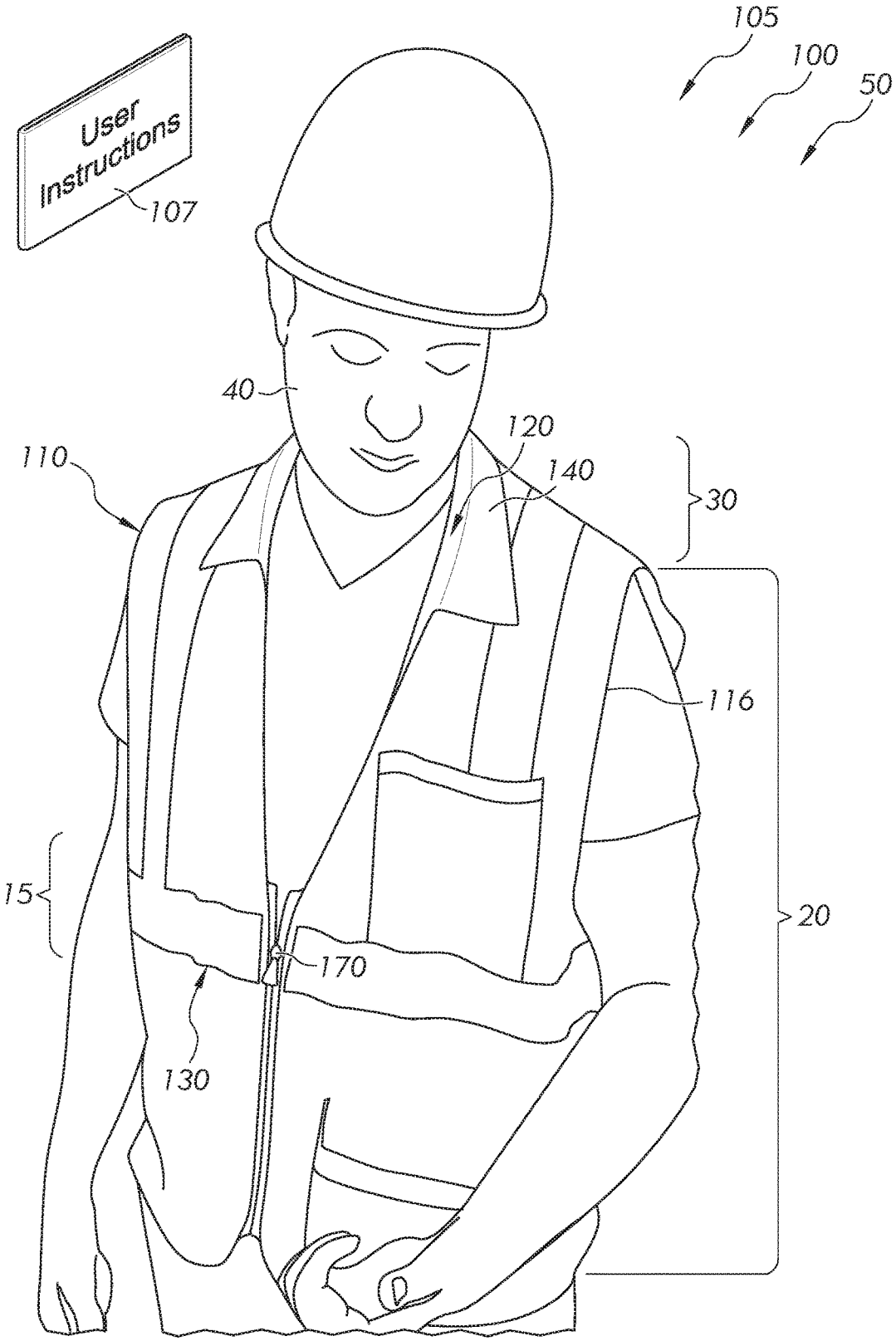
FIG. 1 is a perspective view of a high-visibility vest during an 'in-use' condition, according to an embodiment of the disclosure.

FIG. 1 shows a high-visibility vest 100 during an 'in-use' condition 50, according to an embodiment of the present disclosure. As illustrated, the high-visibility vest 100 may include a sleeveless garment 110 configured to be worn on a torso of the wearer-user 40, a collar 120 that is coupled to the sleeveless garment 110 and configured to be worn on a neck area 30 of the wearer-user 40, a plurality of reflective torso stripes 130 affixed to the sleeveless garment 110, and a reflective collar stripe 140 affixed to the collar 120. Advantageously, the high-visibility vest 100 may be beneficial for use by a wearer-user 40 to provide higher visibility to the torso area 20 (including a midriff area 15) and the neck area 30 of the wearer-user 40 with a polished and professional appearance.

According to one embodiment, the high-visibility vest 100 may be arranged as a kit 105. In particular, the high-visibility vest 100 may further include a set of instructions 107. The instructions 107 may detail functional relationships in relation to the structure of the high-visibility vest 100 such that the high-visibility vest 100 can be used (e.g., how to attach the collar 120 to the sleeveless garment 110), maintained, or the like, in a preferred manner.

Figure 2:
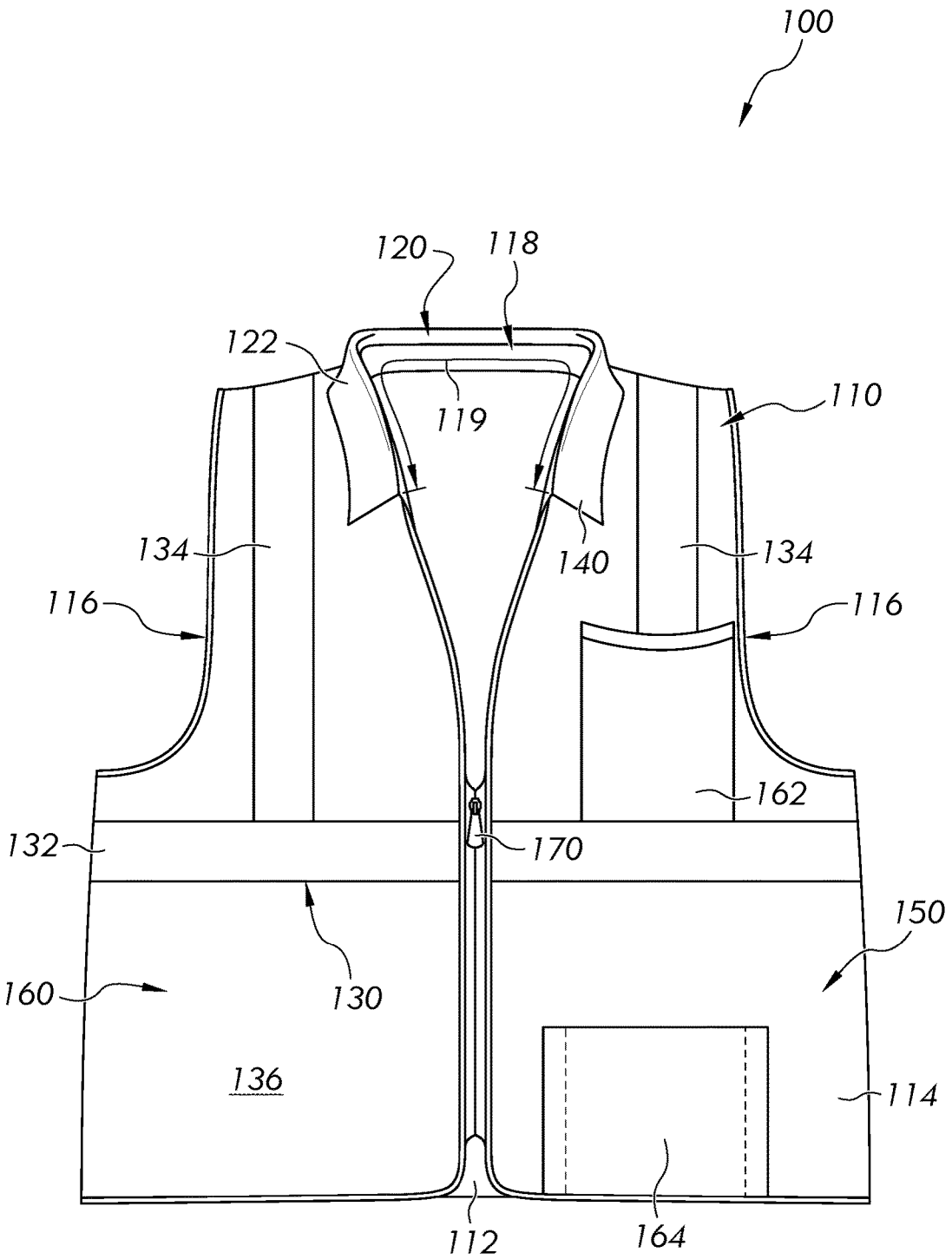
FIG. 2 is a front view of the high-visibility vest of FIG. 1, according to an embodiment of the present disclosure.

FIG. 2 shows the high-visibility vest 100 of FIG. 1, according to an embodiment of the present disclosure. As above, the high-visibility vest 100 may include the sleeveless garment 110 with the plurality of reflective torso stripes 130 affixed, and the collar 120 with the reflective collar stripe 140 affixed. As customary, the sleeveless garment 110 may have an inside 112 and an outside 114, and include two arm-apertures 116 and a neck-aperture 118. Furthermore, the neck aperture 118 may have an interior circumference 119 (shown here as discontinuous as the sleeveless garment 110 is open/unzipped).

The collar 120 may be coupled to the sleeveless garment 110 and extend outward from the neck-aperture 118. Also, the collar 120 may include an outward fold 122, for example, similar to a dress shirt collar. The collar 120 may be coupled to the sleeveless garment 110 and extend outward from the neck-aperture 118, thus enabling the collar to have the outward fold 122. The collar 120 may be permanently affixed to the sleeveless garment 110. Moreover, the reflective collar stripe 140 may be affixed to the collar 120, and configured to provide high-visibility of the neck area 30 of the wearer-user 40. The reflective collar stripe 140 may substantially cover the outward fold 122 of the collar 120 so as to provide the high-visibility.

The plurality of reflective torso stripes 130 may be affixed to the sleeveless garment 110 in the torso area 20 (FIG. 1) of the outside 114 of the sleeveless garment 110. The plurality of reflective torso stripes 130 may be configured to provide high-visibility of the torso 10 of the wearer-user 40. The plurality of reflective torso stripes 130 may include a horizontal reflective torso stripe 132 around a midriff area 15 (FIG. 1), relative to the wearer-user 40 (FIG. 1) when the high-visibility vest 100 is worn.

The plurality of reflective torso stripes 130 may further include a pair of vertical reflective torso stripes 134 that extend from a front 136 to a back 138 (FIG. 3) of the sleeveless garment 110, relative to the wearer-user 40 when the high-visibility vest 100 is worn. Each of the pair of vertical reflective torso stripes 134 may extend between the neck aperture 118 and one of the two arm-apertures 116, respectively. The pair of vertical reflective torso stripes 134 may perpendicularly intersect the horizontal reflective torso stripe 132.

The plurality of reflective torso stripes 130 may be configured to provide high-visibility of the torso 20 of the wearer-user 40. The plurality of reflective torso stripes 130 and the reflective collar stripe 140 may have a width of at least an inch.

According to one embodiment, the sleeveless garment 110 may be configured as a vest having a right front flap 160, a left front flap 150, and at least one fastener 170 configured to couple the right front flap 160 to the left front flap 150. The at least one fastener 170 may include a zipper.

The sleeveless garment 110 may further include an upper outside-pocket 162 integrated with at least one of the right front flap 160 and the left front flap 150. The plurality of reflective torso stripes 130 may be affixed to the sleeveless garment 110 in areas excluding the upper outside-pocket 162. Such an arrangement may allow the upper outside-pocket 162 to be of lower visibility in dim lit areas.

The sleeveless garment 110 may further include a lower outside-pocket 164 integrated with at least one of the right front flap 160 and the left front flap 150. The lower outside-pocket 164 may be positioned below the upper outside-pocket 162, relative to the wearer-user 40 when the high-visibility vest 100 is worn. The sleeveless garment 110 may further include an inside-pocket integrated with at least one of the right front flap 160 and the left front flap 150. The inside-pocket may be accessible from the inside 112 of the right front flap 160 and the left front flap 150, relative to the inside 112 the sleeveless garment 110. The inside-pocket 166 may not be visible from the outside 114 of the sleeveless garment 110.

Figure 3:
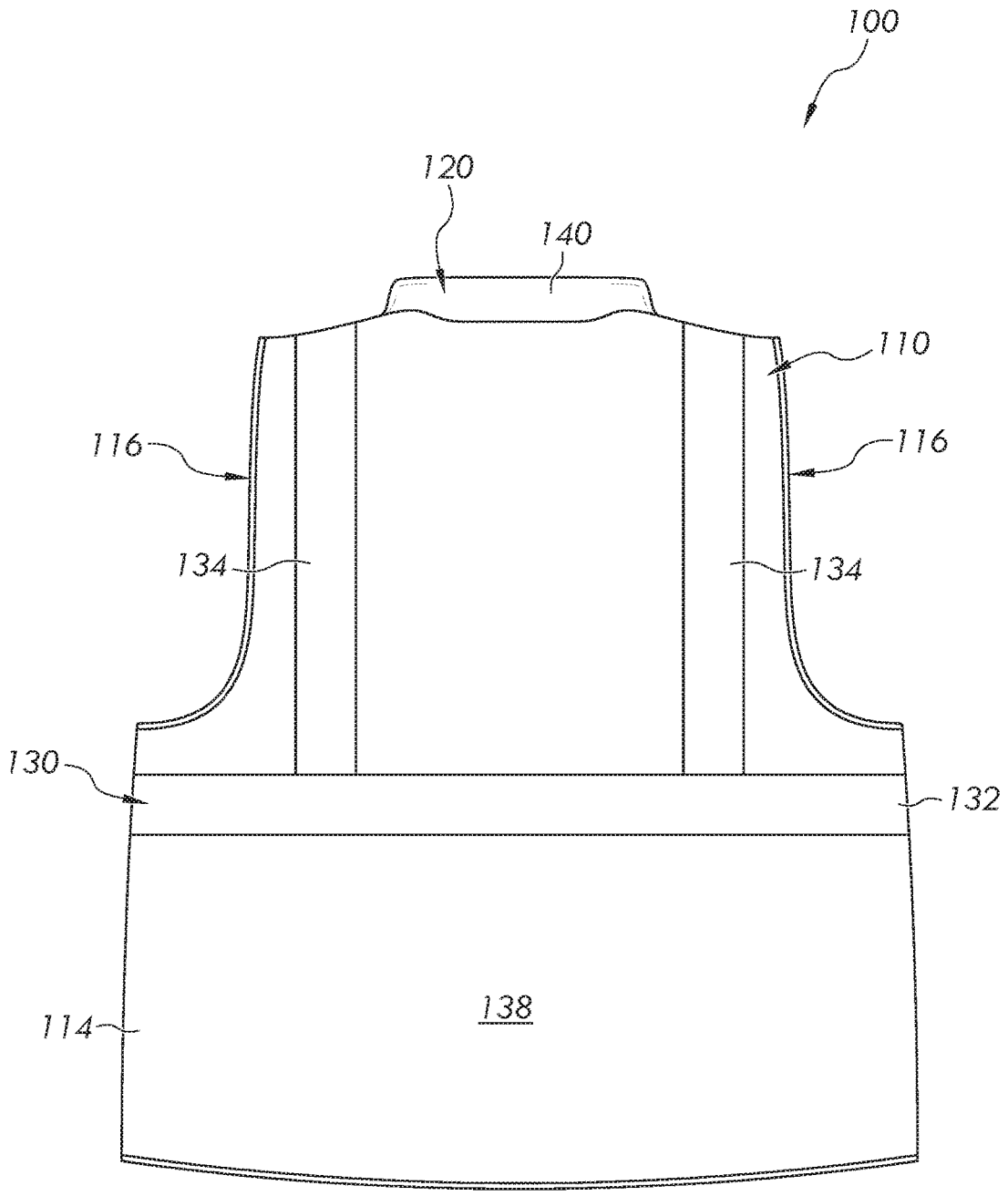
FIG. 3 is a back view of the high-visibility vest of FIG. 1, according to an embodiment of the present disclosure.

FIG. 3 is a back view of the high-visibility vest 100 of FIG. 1, according to an embodiment of the present disclosure. The high-visibility vest 110 may be used in a variety of work safety environments where it is essential that the plurality of reflective torso stripes 130 and the reflective collar stripe 140 are made of high visibility material. High visibility material may be visibly discernable from any background and include reflective properties. Furthermore, the sleeveless garment 110 may be made of a fluorescent material. Fluorescent material may be vividly bright and glowing.

Figure 4:
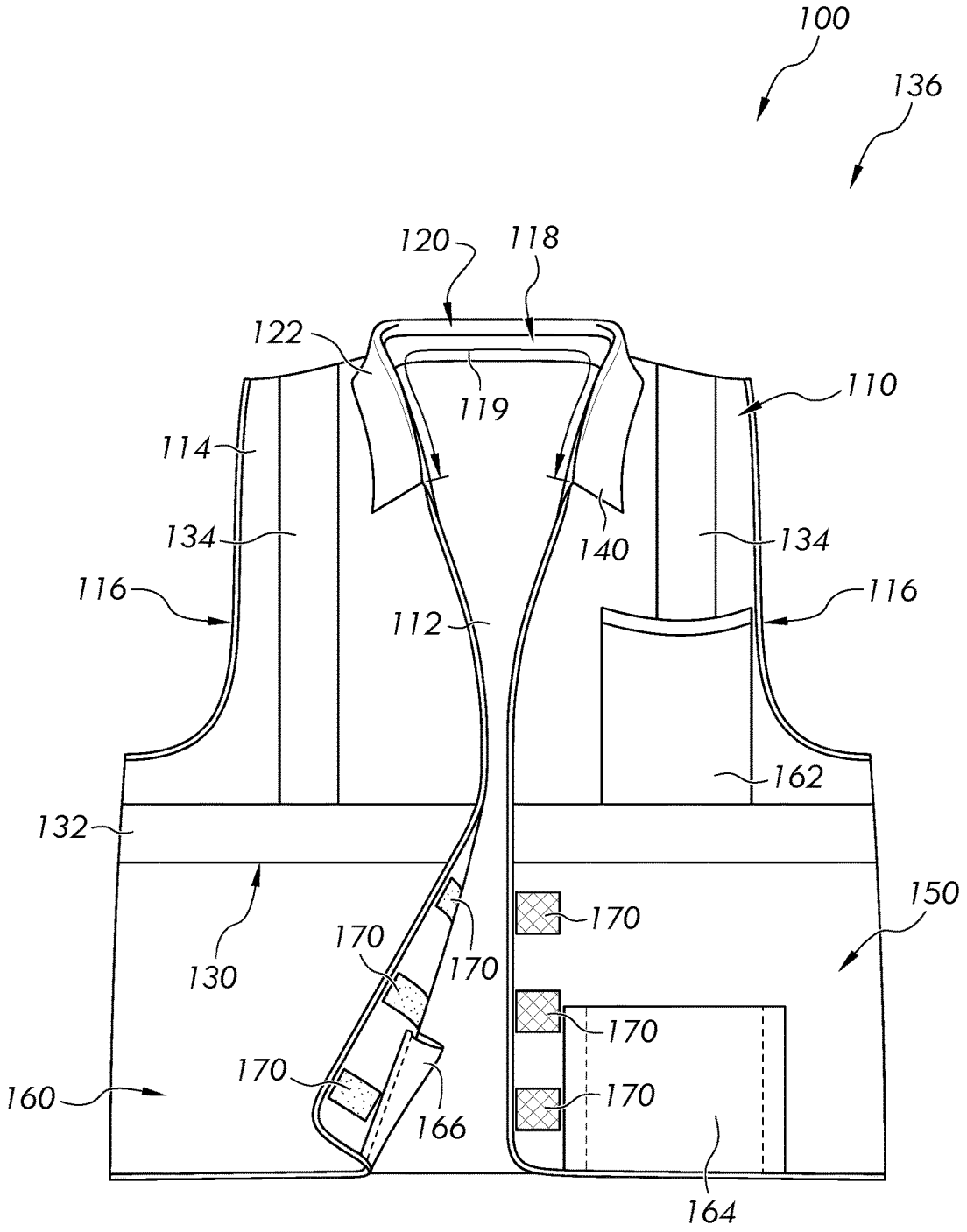
FIG. 4 is a front view of a high-visibility vest, according to another embodiment of the present disclosure.

FIG. 4 is a front view of a high-visibility vest 100, according to another embodiment of the present disclosure. As above, the sleeveless garment 110 may be configured as a vest having the right front flap 160, the left front flap 150, and the at least one fastener 170 configured to couple the right front flap 160 to the left front flap 150. As shown here, the at least one fastener 170 may include a plurality of independent fasteners, such as hook and loop fasteners, buttons, etc. Alternately, the at least one fastener 170 may include a hook and loop fastener strip arranged as the zipper in FIG. 2.

Figure 5:
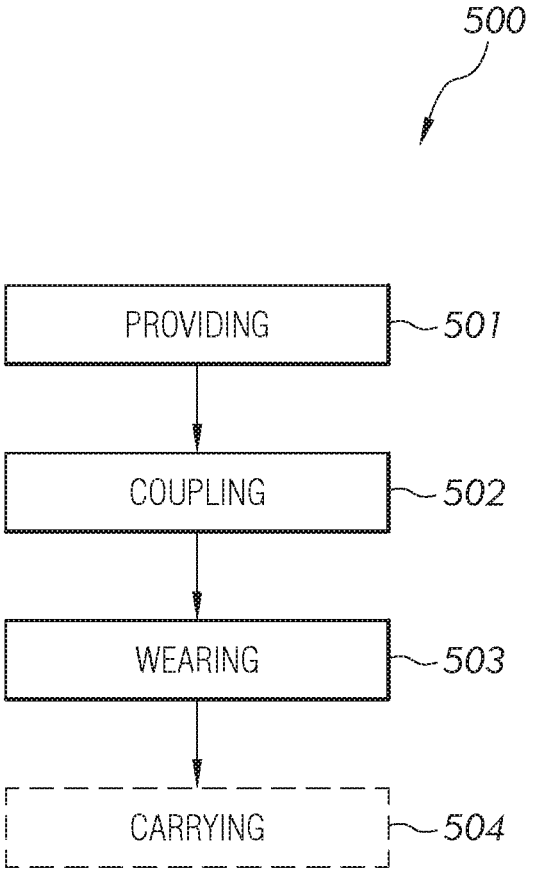
FIG. 5 is a flow diagram illustrating a method of using a high-visibility vest, according to an embodiment of the present disclosure.

Upon reading this specification, it should be appreciated that, under appropriate circumstances, considering such issues as user preferences, design preference, structural requirements, marketing preferences, cost, available materials, technological advances, etc., other fastening arrangements such as, for example, buttons, etc., may be sufficient FIG. 5 is a flow diagram illustrating a method for using a high-visibility vest 500, according to an embodiment of the present disclosure. In particular, the method for using the high-visibility vest 500 may include one or more components or features of the high-visibility vest 100 as described above. As illustrated, the method 500 may include the steps of: step one 501, providing a high-visibility vest including a sleeveless garment and a plurality of reflective torso stripes affixed to the sleeveless garment in a torso area of an outside surface of the sleeveless garment; step two 502, coupling a collar to the sleeveless garment, said collar including a reflective collar stripe affixed to the collar, and said collar coupled in an upper area of the sleeveless garment such that it is configured to provide high-visibility of a neck area of a wearer-user; and step three 503, wearing the high-visibility vest with the collar coupled thereto. According to one embodiment, the high-visibility vest may include the upper outside-pocket 162, the lower outside-pocket 164, and the inside pocket 166, and the method 500 may further include step four 504, carrying items in the upper outside-pocket 162, the lower outside-pocket 164, and the inside pocket 166.

It should be noted that step two 502 is an optional step and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for using the high-visibility vest 500 are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A high-visibility vest for a wearer-user, the high-visibility vest comprising:

a sleeveless garment configured to be worn on a torso of the wearer-user, the sleeveless garment having an inside and an outside, and including two arm-apertures and a neck-aperture, the neck aperture having an interior circumference;

a collar coupled to the sleeveless garment and extending outward from the neck-aperture, the collar including an outward fold;

a plurality of reflective torso stripes affixed to the sleeveless garment in a torso area of the outside of the sleeveless garment, the plurality of reflective torso stripes configured to provide high-visibility of the torso of the wearer-user; and a reflective collar stripe affixed to the collar, and configured to provide high-visibility of a neck area of the wearer-user.

2. The high-visibility vest of claim 1, wherein the sleeveless garment is configured as a vest having a right front flap, a left front flap, and at least one fastener configured to couple the right front flap to the left front flap.

3. The high-visibility vest of claim 2, wherein the at least one fastener includes a zipper.

4. The high-visibility vest of claim 2, wherein the at least one fastener includes a hook and loop fastener.

5. The high-visibility vest of claim 2, further comprising an upper outside-pocket integrated with at least one of the right front flap and the left front flap.

6. The high-visibility vest of claim 5, wherein the plurality of reflective torso stripes are affixed to the sleeveless garment in areas excluding the upper outside-pocket.

7. The high-visibility vest of claim 5, further comprising a lower outside-pocket integrated with at least one of the right front flap and the left front flap, the lower outside-pocket positioned below the upper outside-pocket, relative to the wearer-user when the high-visibility vest is worn.

8. The high-visibility vest of claim 2, further comprising an inside-pocket integrated with at least one of the right front flap and the left front flap, the inside-pocket accessible from the inside of the right front flap and the left front flap, relative to the inside the sleeveless garment.

9. The high-visibility vest of claim 1, wherein the collar is permanently affixed to the sleeveless garment.

10. The high-visibility vest of claim 1, wherein the reflective collar stripe substantially cover the outward fold of the collar.

11. The high-visibility vest of claim 1, wherein the plurality of reflective torso stripes and the reflective collar stripe are made of high visibility material.

12. The high-visibility vest of claim 1, wherein the sleeveless garment is made of a fluorescent material.

13. The high-visibility vest of claim 1, wherein the plurality of reflective torso stripes are positioned on the outside of the sleeveless garment, and include a horizontal reflective torso stripe around a midriff area, relative to the wearer-user when the high-visibility vest is worn.

14. The high-visibility vest of claim 13, wherein the plurality of reflective torso stripes further include a pair of vertical reflective torso stripes that extend from a front to a back of the sleeveless garment, relative to the wearer-user when the high-visibility vest is worn, each of the pair of vertical reflective torso stripes extending between the neck aperture and one of the two arm-apertures, respectively.

15. The high-visibility vest of claim 14, wherein the pair of vertical reflective torso stripes perpendicularly intersect the horizontal reflective torso stripe.

16. The high-visibility vest of claim 1, wherein the plurality of reflective torso stripes and the reflective collar stripe have a width of at least an inch.

17. A high-visibility vest for a wearer-user, the high-visibility vest comprising:

a sleeveless garment configured to be worn on a torso of the wearer-user, the sleeveless garment having an inside and an outside, and including two arm-apertures and a neck-aperture, the neck aperture having an interior circumference;

a collar coupled to the sleeveless garment and extending outward from the neck-aperture, the collar including an outward fold;

a plurality of reflective torso stripes affixed to the sleeveless garment in a torso area of the outside of the sleeveless garment, the plurality of reflective torso stripes configured to provide high-visibility of the torso of the wearer-user;

a reflective collar stripe affixed to the collar, and configured to provide high-visibility of a neck area of the wearer-user;

an upper outside-pocket;

a lower outside-pocket positioned below the upper outside-pocket, relative to the wearer-user when the high-visibility vest is worn; and an inside-pocket; and wherein the sleeveless garment is configured as a vest having a right front flap, a left front flap, and at least one fastener configured to couple the right front flap to the left front flap;

wherein the at least one fastener includes a zipper;

wherein the upper outside-pocket is integrated with at least one of the right front flap and the left front flap;

wherein the plurality of reflective torso stripes are affixed to the sleeveless garment in areas excluding the upper outside-pocket;

wherein the lower outside-pocket is integrated with at least one of the right front flap and the left front flap;

wherein the inside-pocket is integrated with at least one of the right front flap and the left front flap, the inside-pocket being accessible from the inside of the right front flap and the left front flap, relative to the inside the sleeveless garment;

wherein the collar is permanently affixed to the sleeveless garment;

wherein the reflective collar stripe substantially cover the outward fold of the collar;

wherein the plurality of reflective torso stripes and the reflective collar stripe are made of high visibility material;

wherein the sleeveless garment is made of a fluorescent material;

wherein the plurality of reflective torso stripes are positioned on the outside of the sleeveless garment, and include a horizontal reflective torso stripe around a midriff area, relative to the wearer-user when the high-visibility vest is worn;

wherein the plurality of reflective torso stripes further include a pair of vertical reflective torso stripes that extend from a front to a back of the sleeveless garment, relative to the wearer-user when the high-visibility vest is worn, each of the pair of vertical reflective torso stripes extending between the neck aperture and one of the two arm-apertures, respectively;

wherein the pair of vertical reflective torso stripes perpendicularly intersect the horizontal reflective torso stripe; and wherein the plurality of reflective torso stripes and the reflective collar stripe have a width of at least an inch.

18. The high-visibility vest of claim 17, further comprising set of instructions; and wherein the high-visibility vest is arranged as a kit.

19. A method of using a high-visibility vest, the method comprising the steps of:

providing a high-visibility vest including a sleeveless garment and a plurality of reflective torso stripes affixed to the sleeveless garment in a torso area of an outside surface of the sleeveless garment;

coupling a collar to the sleeveless garment, said collar including a reflective collar stripe affixed to the collar, and said collar coupled in an upper area of the sleeveless garment such that it is configured to provide high-visibility of a neck area of a wearer-user; and wearing the high-visibility vest with the collar coupled thereto.

20. The method of claim 19, wherein the high-visibility vest includes an upper outside-pocket, a lower outside-pocket, and an inside pocket, the method further comprising the step of containing additional items in the upper outside-pocket, the lower outside-pocket, and the inside pocket.

* * * * *